United States Patent [19]

Van Kuiken, Jr.

[11] Patent Number: 4,780,027

[45] Date of Patent: Oct. 25, 1988

[54] SYSTEM FOR SUPPLYING BLASTING MEDIA TO A MEDIA BLASTING SYSTEM

[75] Inventor: Lewis L. Van Kuiken, Jr., Grand Rapids, Mich.

[73] Assignee: Progressive Blasting Systems, Inc., Kentwood, Mich.

[21] Appl. No.: 940,249

[22] Filed: Dec. 10, 1986

[51] Int. Cl.[4] ..... B65G 53/66

[52] U.S. Cl. ..... 406/25; 406/12; 406/28; 406/124; 406/126

[58] Field of Search ..... 406/10, 12, 22–25, 406/28, 29, 32, 50, 85, 93, 108, 124–127, 132, 169

[56] References Cited

U.S. PATENT DOCUMENTS

| | | | |
|---|---|---|---|
| 1,369,649 | 2/1921 | Gieseler | 406/169 |
| 2,511,017 | 6/1950 | Sherban | 406/126 X |
| 2,594,072 | 4/1952 | Ridley | 406/124 X |
| 3,994,701 | 11/1976 | Schweimanng | 406/124 X |
| 4,108,500 | 8/1978 | Stamer | 406/124 X |
| 4,482,275 | 11/1984 | Shinozaki et al. | 406/12 |
| 4,488,837 | 12/1984 | Mizokawa et al. | 406/23 X |
| 4,628,824 | 12/1986 | Goding et al. | 105/168 |

FOREIGN PATENT DOCUMENTS

| | | | |
|---|---|---|---|
| 51618 | 3/1982 | Japan | 406/124 |
| 361950 | 2/1973 | U.S.S.R. | 406/126 |
| 324103 | 1/1930 | United Kingdom | 406/126 |
| 834052 | 5/1960 | United Kingdom | 406/126 |

OTHER PUBLICATIONS

"Low Maintenance Pressure Pot System Two-Stage Continuous Blasting", 2 pp. with Drawing "DRG177LVK".

*Primary Examiner*—Sherman D. Basinger
*Assistant Examiner*—Paul E. Salmon
*Attorney, Agent, or Firm*—Price, Heneveld, Cooper, DeWitt & Litton

[57] ABSTRACT

A system for supplying blasting media to a media blasting system in which a pair of pressure pots or pressure chambers are provided in which the blasting media is introduced for dispensing the media to conduits leading to blasting guns. The media supply valves and air supply valves are controlled by a cam shaft assembly. Further, a metering hopper having a media supply valve is provided between the storage hopper and upper pressure pot or chamber. The media and air valves are operated in timed sequence as determined by the cam shaft assembly.

12 Claims, 3 Drawing Sheets

JUST PRIOR TO LOW MEDIA SIGNAL
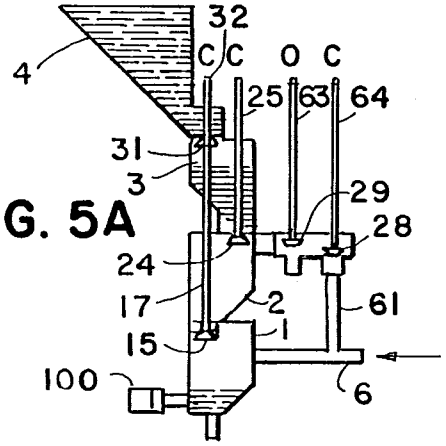
FIG. 5A
LOW MEDIA SIGNAL
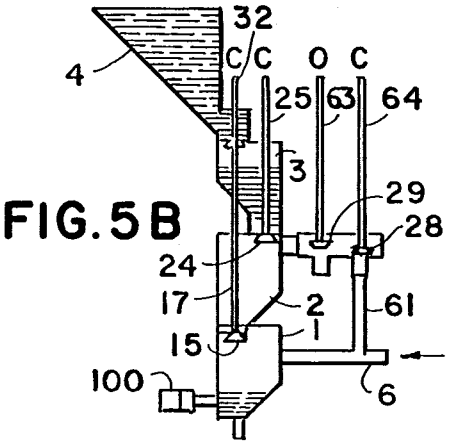
FIG. 5B
FILL UPPER PRESSURE CHAMBER
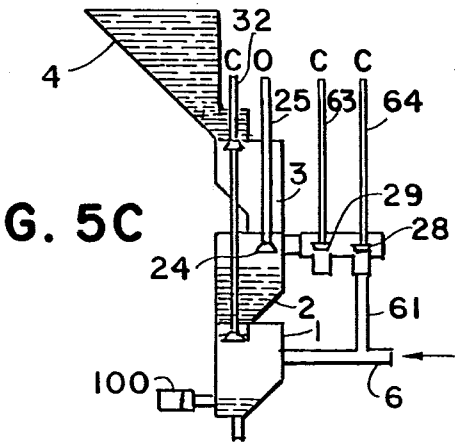
FIG. 5C
PRESSURIZE UPPER PRESSURE CHAMBER
FIG. 5D
FILL METERING HOPPER & LOWER PRESSURE CHAMBER
FIG. 5E
METERING HOPPER FULL WAIT FOR LOW MEDIA
FIG. 5F

SYSTEM FOR SUPPLYING BLASTING MEDIA TO A MEDIA BLASTING SYSTEM

FIELD OF THE INVENTION

This invention relates to a system and apparatus for supplying blasting media to a media blasting system. This type of system is normally referred to as a pressure pot system which continuously supplies blasting media to a line or conduit which is connected to one or more blasting guns which are fed the blasting media from the pressure pot system.

The assignee of this invention sometime ago designed a pressure pot system which comprised a storage hopper and two pressure pots located under the storage hopper with one pot located directly over the other. A valve is located between the storage hopper and the upper pot for controlling the transfer of media from the storage hopper to the upper pot. A second valve is located between the upper and the lower pot for transferring the media from the upper pot to the lower pot. Air intake and exhaust valves are provided to control the supply and exhaust of air from the pots in a predetermined sequence.

With this apparatus, during normal operation the valve between the upper and lower pots is closed. The lower pot is under pressure and the media is flowing to the blast guns from it. The media delivered by the blast guns is returning from the blast cabinet to the upper pot. The lower pot has a probe for indicating when the media reaches a predetermined low within the lower pot. When the lower pot signals that it is getting low on media, the valve above the upper pot closes and the upper pot is pressurized. When both pots are under the same pressure, the valve between the upper and lower pots is opened and the media flows from the upper to the lower pot. After all the media has been transferred to the lower pot, the valve between the upper and lower closes again, the upper pot pressurizes and the valve above the upper pot opens to permit the media to flow from the storage hopper into the upper pressure pot. While the media is filling the upper pressure pot, the lower pressure pot is under pressure and the media continues to flow the blast guns from the lower pot.

In this apparatus, the opening and closing of the air valves controlling the pressure within the pots and the control of the media valve between the upper storage hopper and the two storage pots is entirely accomplished by air actuated valves which in turn are controlled electronically.

The above described apparatus is relatively large in size, requires constant maintenance because of the electronically controlled, air-actuated valves. Such maintenance requires highly skilled technicians and when not operating properly, it is difficult to determine exactly where the problem is. In other words, the complexity of the apparatus requires expertise in trouble shooting any problems. Further, pressure pots tend to build up media material within the pots which hardens and causes blockage requiring periodic cleaning of the pots. In addition, the valves leading into the pressurized pots closes on the media flowing through the valves, creates problems by reason of the valve not being able to completely close. Further, the valves have a tendency to wear when closed on the media.

As a result of these problems with the prior art devices as above described, there has been a need for a device that was smaller in size, that required less maintenance, that required the minimum amount of media to charge the system, had a instant reaction time when changing air pressures and that cured the other faults and disadvantages of the above described system.

SUMMARY OF THE INVENTION

The present invention was conceived because of this long felt need of a different system that did not have the faults and disadvantages of the prior art. In accordance with the invention, air-actuator valves controlled electronically have been replaced by a control consisting of a cam shaft assembly which actuates both the media flow valves and the air pressure valves of the pressure pots. Further, a metering hopper is inserted between the media storage means and the upper pressure pot or chamber.

The heart of this invention is the cam shaft assembly which includes five cams, three for actuating the media flow valves. One of these valves is located between the storage hopper and the measuring hopper, another between the measuring hopper and the upper pressure chamber or pressure pot and the third between the upper and lower pressure chambers or pots. The other two cams actuate the air supply valve and air exhaust valve for controlling the pressure within the upper pressure pot.

Each revolution of the cam shaft causes a complete cycle of the apparatus. This cycle briefly including a stage in which the lower pressure chamber or pot is supplying or feeding media to the blasting guns. Located near the bottom of the lower pressure chamber is a proximity probe which signals when the lower chamber is low on media in which event the signal turns on the motor which actuates the cam shaft to rotate the cams one revolution. During each revolution, the valve between the metering and the upper pressure chamber opens and the media flows into the upper pressure chamber while the exhaust valve which controls the communicating of an exhaust pipe with the upper chamber is open and the air supply valve is closed by their respective cams. The cam shaft assembly then causes the exhaust valve to close and the air supply valve to open creating positive pressure in the upper chamber equal to the lower pressure chamber. The valve between the two pressure chambers is then opened by its cam and the media transfers from the upper pressure chamber into the lower pressure chamber. Simultaneously, the valve between the storage hopper and the measuring hopper opens and media flows into the metering chamber. After a predetermined time when the metering hopper is full, the cam shaft assembly causes the valve between the media storage hopper and the metering hopper to close and the valve between the upper and lower pressure chambers also to close. At the same time the air exhaust valve opens and the upper pressure pot exhausts and the pressure in the upper pressure chamber goes to atmosphere. This completes one cycle which occurs just previous to the dispensing of the entire media from the lower pressure chamber. During this entire cycle, the lower pressure chamber is dispensing or feeding media to the blasting guns which is continuous without any interruption. The cycle is repeated when the proximity probe at the bottom of the lower pressure chamber again signals the motor to start a new cycle.

With this system, the size of the equipment is much smaller because the hoppers and pressure chambers are stacked one on the other with the media transfer valves built into the chambers and hoppers.

The present invention, by reason of the metering hopper, reduces the amount of media necessary to charge the entire system. Such reduction is from 1500 pounds required by the above described prior system to 500 pounds required by the present invention.

As pertains to the other specific features of the present apparatus, the sides of the chambers are inclined downwardly and the media flow valves are inverted, cone-shaped which close upon V-shaped openings or ports located between the metering hopper and the upper pressure chamber and between the upper and lower pressure chambers. Thus, the apparatus is more self cleaning since the media flows downwardly along the inclined sides of the chamber and the incline of the V-shaped openings in the bottoms of the metering chamber and the upper pressure chamber. Further, the shape of the valve elements and the ports assures that in the pressurized areas of the pressure chambers, the valve elements never close on the media flowing through the valves. This has a decided advantage in maintenance.

In addition, the cam shaft assembly means for controlling the valves greatly simplifies an understanding of the structure and thereby simplifies trouble shooting since the structure is readily visible and there are very few hidden mechanical or electrical parts.

Having briefly described the invention, a more complete and full understanding of the same will become evident upon a review of the attached drawings and the accompanying description, wherein:

BRIEF DESCRIPTION OF THE DRAWINGS

FIGS. 5A–5F, inclusive, are schematic diagrams of the apparatus illustrating a cycle of operation of the present invention.

BRIEF DESCRIPTION OF THE PREFERRED EMBODIMENT

Figure 1:
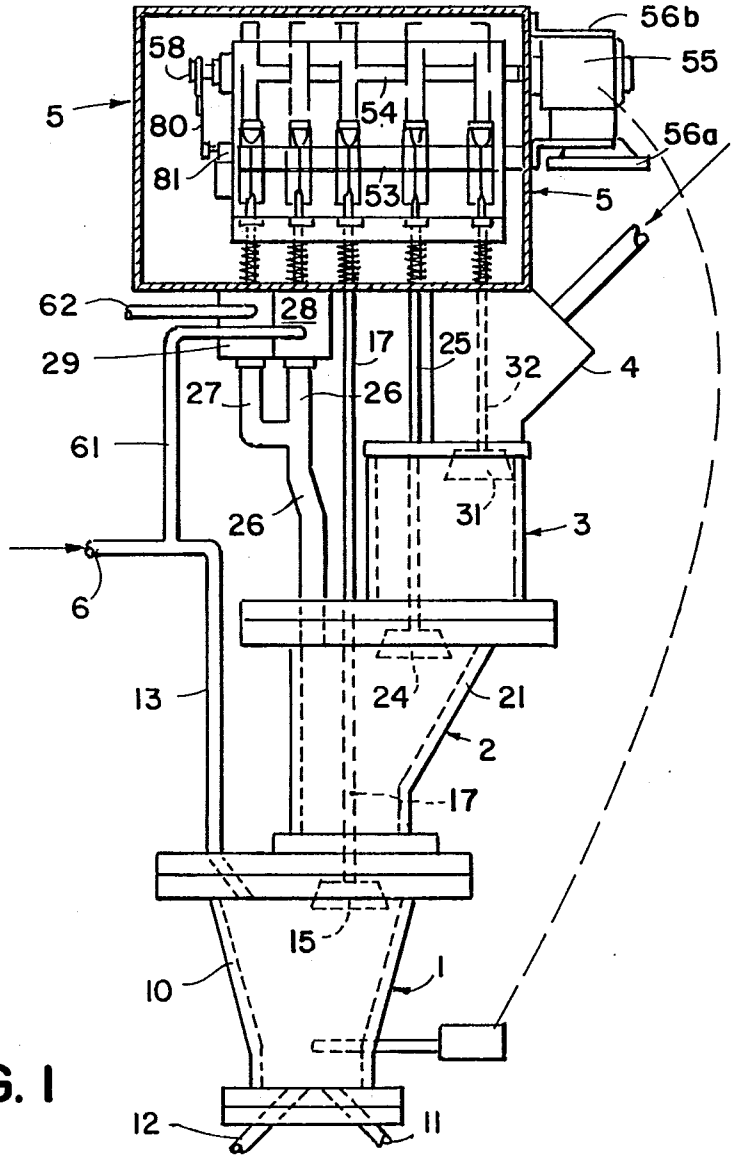
FIG. 1 is a side elevational view of the apparatus.

Referring more specifically to FIG. 1, reference numeral 1 designates a lower pressure chamber on which is stacked an upper pressure chamber 2, measuring hopper 3 and a storage hopper 4. Mounted above the storage chamber 4 is a cam shaft assembly 5 for controlling the flow of medium from the storage hopper to the measuring hopper 3, from the measuring hopper 3 to the upper pressure chamber 2 and from the upper pressure chamber 2 to the lower pressure chamber 1. The cam shaft assembly 5 also controls pressurization and exhaustion of the upper pressure chamber 2.

Lower pressure chamber 1, which is sometimes referred to as a pressure pot, has inclined sides 10 so that the media inside is forced downwardly by gravity to as to eliminate any hang-up within the inner walls of the chamber.

Openings are provided in the bottom wall of the chamber 1 for flow of the blasting media through the conduits 11 and 12 which conventionally are connected to the blasting conduits of the blasting guns.

The pressure chamber 1 is always under pressure from the air supply tube 13 which is connected to the main air supply tube 6. In the bottom area of chamber 1 is mounted a conventional probe 100 which electronically senses when the media falls below a predetermined level. Probe 100 is operatively connected to the motor 55 through any well-known circuit for starting the motor 55 as will be described hereinafter.

The lower pressure chamber 1 communicates with the upper pressure chamber 2 by means of the port 14 (FIG. 2) which is adapted to be opened and closed by the lower pressure chamber valve 15 which, as disclosed, is inverted cone-shaped and is adapted to seat o the seat 16. Valve element 15 is attached to the bottom end of a push rod 17 which extends upwardly to the cam shaft assembly 5, as will be explained hereinafter.

Figure 2:
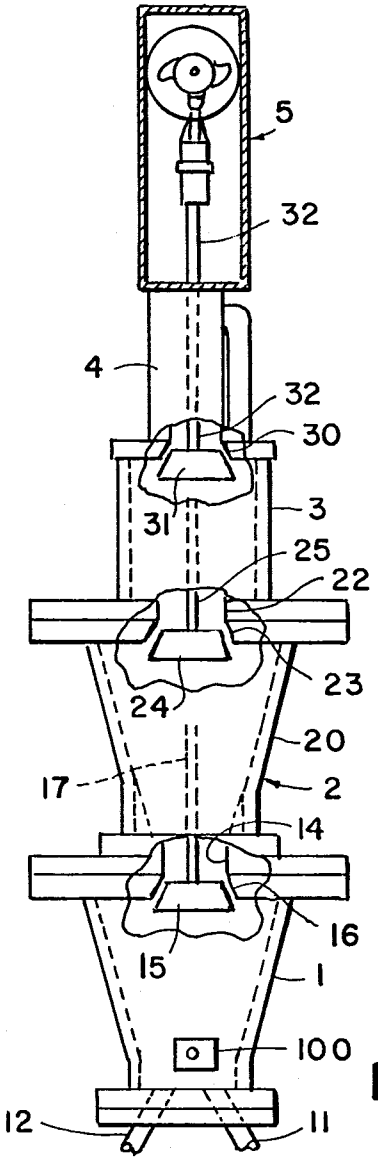
FIG. 2 is a front elevational view of the apparatus with portions cut out for the purpose of illustrating the media flow valves.

The upper pressure chamber 2 is mounted on top of the lower pressure chamber 1 and it also, as disclosed in FIGS. 1 and 2, has the inclined sides 20 and 21 which cause the media to slide downwardly and thus is prevented from being caught on the inside wall of the sides. Pressure chamber 2 also has a port 22 terminating in the seat 23 having inclined sides as disclosed in FIG. 2. Port 22 is adapted to be opened or closed by the valve element 24 attached to the end of a push rod 25 which extends upwardly to the cam shaft assembly 5 and is actuated thereby as will be disclosed hereinafter.

The metering hopper 3 is mounted on top of the upper pressure chamber 2 and is in communication with the upper pressure chamber 2 through the port 22. The metering hopper is of a size to contain a volume of blasting media for nearly filling the pressure chamber 2 which is of a size that will contain a volume of media substantially the same as pressure chamber 1. Thus, when the blasting media from the metering hopper 3 is deposited into the upper pressure chamber 2, the level of the blasting media in chamber 2 is below the seat 23 so that the valve element 24 when closed on the valve seat 23 will not close on any media flowing through port 22 into the chamber 2. This is also true with respect to lower pressure chamber 1, i.e. when the media from upper chamber is dispensed into the lower chamber 1, the level of the media is below seat 16 so that the valve will never close on the media that had flowed through port 14 from chamber 2 into chamber 1.

The metering hopper 3 also has a port 30 forming a seat with inclined sides upon which the valve element 31 is adapted to be seated for closing of the port 30. Valve element 31 is attached to the lower end of the push rod 32 which extends upwardly to the cam shaft assembly 5 for actuating the valve element 31 all as will be explained hereinafter.

An air pressure tube 26 is connected to and communicates with the inside of the pressure chamber 2 for pressurizing and exhausting chamber 2 in predetermined time sequence. The air pressure tube 26 is connected to a valve 28 which, in turn, is connected to the air supply tube 61 which when the valve 28 is actuated to an open position, supplies pressurized air through tube 26 to the inside of chamber 2. Also connected to the tube 26 is the exhaust conduit 27 which, in turn, is connected to an exhaust valve 29 which when actuated to open position exhausts air from inside chamber 2 through tube 26, conduit 27 and valve 29 through the exhaust tube 62.

It should be evident from FIG. 1 that each of the media flow valves 31, 24 and 15 are controlled by the cam shaft assembly 5. Further, the air valves 28 and 29 are also controlled by the cam shaft assembly 5 which will now be described in relation to FIG. 3.

Figures 3, 4:
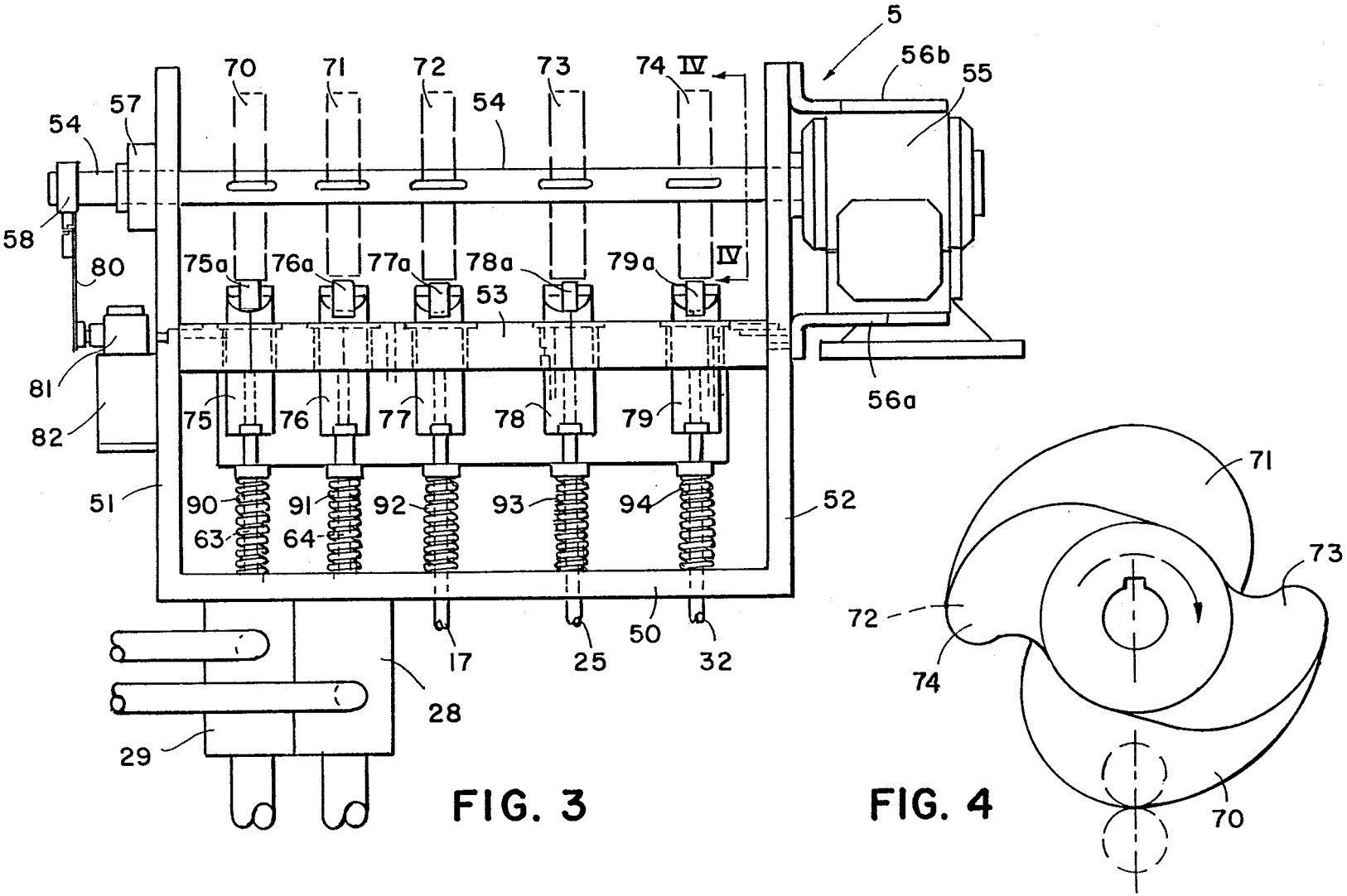
FIG. 3 is an enlarged side elevational view of the cam shaft assembly.
FIG. 4 is a cross sectional view taken along the plane IV—IV of FIG. 3, showing the various shapes of the cams on the cam shaft.

FIG. 3 discloses in greater detail the cam shaft assembly 5 which includes the cam mount base plate 50, the cam mount plate 51 extending upwardly from the left end of plate 50 as viewed by FIG. 3, and the right cam mount plate 52 extending upwardly from the right end of the base plate 50. Mounted between the two plates 51 and 52 is the guide plate 53 and the cam shaft 54 which is driven by the motor 55 mounted on the mount plate 52 by the brackets 56A and 56B. A plurality of cams 70, 71, 72, 73 and 74 are spacedly mounted on the cam shaft 54 which is mounted at the end opposite motor 52 in a bearing 57. Attached to the end of the cam shaft 54 is an actuating cam 58 for actuating a switch arm 80 of the control switch 81 mounted on the support 82 attached to the side mount plate 51.

The cams 70-74, inclusive, are provided for actuating the push rods 63, 64, 17, 25 and 32, respectively. They are shaped as disclosed in FIG. 4 to sequentially actuate the push rods for controlling the air valves 29 and 28 and the media flow valves 15, 24 and 31.

As disclosed in FIG. 3, each of the push rods 63, 64, 17, 25, and 32 are secured to tappets 75, 76, 77, 78 and 79, respectively. Tappets 75, 76, 77, 78 and 79 are slidably mounted within sleeved openings in the guide plate 53 and include roller elements 75A, 76A, 77A, 78A and 79A, respectively. These rollers are forced against and contact the cams by means of the springs 90, 91, 92, 93 and 94, respectively. The tappets are adjusted in a well-known manner so that the exhaust valve 29 is normally open, air supply valve 28 is normally closed, and media flow valve elements 15, 24 and 31 normally close ports 14, 22 and 30, respectively.

It should be understood that exhaust valve 29 and air supply valve 28 are disclosed in block form for the sake of simplicity, the specific construction thereof being irrelevant to the overall invention so long as actuation of push rod 63 closes the exhaust valve and actuation of push rod 64 opens the air supply valve, all as will be explained hereinafter.

OPERATION

The specific operation of this system is illustrated by FIGS. 5A, 5B, 5C, 5D, 5E and 5F. FIG. 5A discloses the system in operation just prior to the time the probe 100, located near the bottom of the lower pressure chamber, gives a signal that the lower pressure chamber 1 is low on media. In this phase of the process, the lower chamber is pressurized and the valve element 15 between the upper and lower chambers is closed. The upper pressure chamber 2 is empty with its media flow valve 24 closed. Metering hopper 3 is full with the media flow valve 31 closed and the storage hopper always nearly completely full it being supplied by the return of the media from the blasting compartments. In this phase of the process, the exhaust valve 29 is open and the air supply valve 28 is closed. This same condition exists in FIG. 5B at the time the low media signal is given by the probe 100. In the phases as represented by FIGS. 5A and 5B the system is blasting. However, at the instant the signal is sent to turn on the cam shaft motor, the motor rotates the cams one revolution which causes the following sequence of operation:

(1) As disclosed in FIG. 5C and referring to FIG. 3, the cam 74 actuates push rod 25 to open the media flow valve 24 between the metering hopper 3 and the upper pressure chamber 2 and the media flows into the upper pressure chamber 2.

(2) As disclosed in FIG. 5D, and in reference to FIG. 3, the cam 71 actuates push rod 64 to open the air supply valve 28. Simultaneously, cam 70 actuates push rod 63 to close the exhaust valve 29. With the air supply valve 28 open and the exhaust valve 29 closed, compressed air is forced into the upper pressure chamber 2 rendering the pressure in the upper chamber 2 equal to the pressure in the lower chamber 1.

(3) As disclosed in FIG. 5E in conjunction with FIG. 3, cam 72 actuates push rod 17 causing valve element 15 to open and the media to flow from chamber 2 to chamber 1. Simultaneously, cam 74 actuates push rod 32 opening media flow 31 causing the media from the storage hopper 4 to flow into and fill the metering hopper 3. Thus, the metering hopper 3 and the lower pressure chamber 1 are simultaneously filled, this being accomplished while the air supply valve 28 is open and the exhaust valve 29 is closed, thus, pressurizing the upper pressurized chamber 2.

(4) The next phase of the operation controlled by the cam shaft assembly is to return the cams to their original position of FIG. 5A, that is, without any of the cams actuating the push rods. In this position the cam 58 on the end of the cam shaft actuates the switch arm 80 which in turn actuates the switch 81 causing the motor 55 to stop at the original position. In this position, the system is blasting, that is, the medium is forced out of the lower chamber 1 into the blasting conduit which leads to the blasting guns.

It should be evident from the above description that the present invention provides all the advantages as noted above; that is, the apparatus has extremely low maintenance, it is of substantially smaller size than prior systems, there is an instant reaction time when changing air pressures, a minimum amount of media is necessary to charge the system, and the system is simple and can be understood and easily trouble shooted.

Although I have disclosed the preferred embodiments of this invention, it should be understood that there may be other modifications and embodiments without departing from the spirit of this invention. Therefore, this invention shall be limited only so far as defined by the following appended claims and their equivalents.

I claim:

1. In a pressure pot system for supplying blasting media under pressure to a pressurized blasting conduit for feeding blasting media to one or more blasting guns, said system including a media storage means and a first and second pressure chambers with means for pressurizing and exhausting said first and second chambers, said media storage means being stacked above said pressure chambers with said first pressure chamber stacked above said second pressure chamber; first and second media valve means for providing communication between said storage means and said first pressure chamber and between said pressure chambers, respectively; air valve means for controlling the air pressurizing and exhausting of said first and second pressure chambers, the improvement comprising:

means for opening and closing said first and second media valve means and said air valve means, said first, second and air valve means being offset from each other in both vertical and horizontal dimensions; push rods extending vertically upward from said valve means and spaced one from the other for actuating said valve means to open and close the same; an overhead cam shaft means mounted above said push rods and having a plurality of spaced cams, each of said cams being aligned and operatively associated with one of said push rods for actuating said push rods and thereby said valve means to control the opening and closing of said first and second media valve means and said air valve means; and actuating means for actuating said cam shaft means.

2. The system of claim 1 in which the valve means is opened and closed in timed sequence for cyclically exhausitng said first pressure chamber while filling the same with media, said second pressure chamber being simultaneously pressurized for dispensing media therefrom into said blasting conduit and thereafter said first chamber is air pressurized causing said second chamber to be filled with media from said first chamber.

3. The system of claim 2 in which a metering hopper is located between and is adapted to be in communication with said storage means and said first chamber and said first media valve means includes a first valve element located between said storage means and said metering hopper and a second valve element located between said metering hopper and said first chamber; a third valve element located between said first and second pressure chambers; push rods extending upwardly from said valve elements; and said cam shaft means including a cam for each of said valve elements, each of said cams being operatively associated with one of said push rods for actuating said valve elements in timed sequence to open the first valve element permitting media in said storage means to flow through said first media valve means and fill said metering hopper with media and simultaneously to open the third media valve element permitting said media in said first chamber to flow through said third media valve and fill said second chamber with media and during said flow of media through said first and third valve elements closing communication between said metering hopper and said first chamber.

4. The system of claim 3 in which the first valve means includes vertically arranged ports between the storage means and metering hopper and between the metering hopper and first pressure chamber, and said second valve means includes a vertically arranged port between the first and second pressure chambers, each vertically arranged port having an upper and lowermost portion, a valve seat at each of the said lowermost portions of said ports, and said first, second and third valve elements each comprising an inverted cone shaped valve element adapted to seat in one of said valve seats and attached to one of said push rods.

5. The system of claim 3 in which during the time when said second pressure chamber is feeding media to the pressurized blasting conduit, said cam shaft means causes said port between the pressure chambers to be closed, the port between the first pressure chamber and metering hopper to be closed, the port between the media storage means and metering hopper to be closed, the air port into the first chamber to be exhausted and the air port into the second chamber to be opened thereby pressurizing said second chamber.

6. The system of claim 5 in which a sensor means is provided for sensing when a predetermined measure of media is low in the second chamber; actuating means for actuating said cam shaft; said sensor operatively controlling the actuation of said actuating means for actuating said cam shaft causing it to revolve one revolution; said revolving of said cam shaft causing the following sequenced steps of operation:

(a) initial actuation of said valve element between said metering hopper and first chamber causing the media in said metering hopper to flow into said first chamber;

(b) the closing of said valve element between said metering hopper and first chamber, and actuation of said air valve means causing pressurization of said first chamber;

(c) the simultaneous opening of the valve means between the storage means and metering hopper thereby causing said metering hopper to be filled with media, opening of the valve means between the first and second chambers thereby causing said second chamber to be filled with media and closing communication between said first chamber and metering hopper; and (d) the simultaneous closing of said valve means between said first and second chambers and the exhausting of said first chamber to atmosphere.

7. The system of claim 1 in which the push rods are biased in a direction against the cams of said cam shaft means.

8. In a pressure pot system for supplying blasting media under pressure to a pressurized blasting conduit for feeding blasting media to one or more blasting guns, said system comprising:

media storage means; a metering hopper; a first pressure chamber; a second pressure chamber; a first valved media port between said storage means and metering hopper; a second valved media port between said metering hopper and first pressure chamber; a third valved media port between said first and second pressure chambers; a first air port means associated with said first pressure chamber; a second air port associated with the second pressure chamber; means for supplying pressurized air to said first and second air port means; a valve element in each of said media ports arranged to open and close said ports to control the flow of media through said media ports; air port control valve elements controlling the flow of air into and out of said air ports for pressurizing and exhausting said first and second pressure chambers; push rods secured to each of said valve elements; and a cam shaft having cams operatively associated with each of said push rods for actuating said push rods and thereby said valve elements to control the opening and closing of said media ports and control the flow of air into and out of said air ports in the following timed sequenced steps of operation:

(a) initial opening of said second valved media port by actuating said valve element between said metering hopper and first chamber to open position causing the media in said metering hopper to flow into said first chamber;

(b) the closing of said second valved media port by closing said valve element between said metering hopper and first chamber, the actuation of said air port control valve elements to cause the pressurization of said first chamber;

(c) the simultaneous opening of the first valved media port by opening the valve element between the storage means and metering hopper thereby causing said metering hopper to be filled with media, the opening of the third valved media port by opening the valve element between the first and second chambers thereby causing said second chamber to be filled with media and closing the second media port by closing said valve element between said first chamber and metering hopper; and (d) the simultaneous closing of the third valve media port by closing said valve element between said first and second chambers and actuating said air port valve elements to exhaust said first chamber to atmosphere and pressurized said second chamber.

9. The system of claim 8 in which the first chamber, second chamber, metering hopper and media storage means are arranged in stacked position one above the other with the first chamber above the second chamber, the metering hopper above the first chamber and the media storage means above the metering hopper; and said push rods extend upwardly and are spaced from each other.

10. The system of claim 8 in which each of the media ports includes an upper and lowermost portion with a valve seat at the lowermost portion of said port, with an inverted cone shaped valve element attached to one of said push rods and adapted to seat on said valve seat.

11. The system of claim 8 in which the push rods are biased in a direction against the cams of said cam shaft means.

12. The system of claim 8 in which a sensor means is provided for sensing when a predetermined measure of media is low in the second chamber; actuating means for actuating said cam shaft; said sensor operatively controlling the actuating means for actuating said cam shaft causing it to revolve one revolution; said revolving of said cam shaft causing the said sequenced steps of operation.

* * * * *